United States Patent [19]

Ullman, Jr.

[11] Patent Number: 4,561,212

[45] Date of Patent: Dec. 31, 1985

[54] INSERT FOR LAMINATED DOORS

[75] Inventor: Myron E. Ullman, Jr., Canfield, Ohio

[73] Assignee: Kessler Products Co., Inc., Youngstown, Ohio

[21] Appl. No.: 428,909

[22] Filed: Sep. 30, 1982

[51] Int. Cl.[4] ..... E06B 3/00

[52] U.S. Cl. ..... 49/503; 70/450; 70/451

[58] Field of Search ..... 49/503, 501, 167; 52/743; 70/450, 451, 461

[56] References Cited

U.S. PATENT DOCUMENTS

| | | | |
|---|---|---|---|
| 3,257,136 | 6/1966 | Russell et al. | 70/451 X |
| 4,080,813 | 3/1978 | McKann | 70/450 |
| 4,118,895 | 10/1978 | Governale | 49/503 |
| 4,218,848 | 8/1980 | Nelson | 49/503 |

*Primary Examiner*—Kenneth Downey
*Attorney, Agent, or Firm*—Browdy and Neimark

[57] ABSTRACT

An insert for positioning between the facing sheets of laminated doors to define lock installation openings and to prevent foamed-in-situ filler material from flowing into lock installation openings during foaming of the door cavity. The insert includes a door edge plate which occupies a portion of the edge of the door, and a receptacle which extends inwardly from the edge plate to locations between the facing sheets. The edge plate defines a plurality of openings, each of a size and shape large enough to accommodate a standard-sized lock bolt assembly. The openings are covered by membranes, any one of which can be removed to permit the receptacle to be attached to the edge plate. The receptacle defines an opening of sufficient size to accommodate standard-sized, door-knob-type lock assembly. An adapter may be installed within the opening of the receptacle to accommodate differently sized lock hardware. All of the insert components can be formed inexpensively using plastics injection-molding techniques. The components of the insert may be assembled in such a way as to accommodate a variety of standard-sized lock mechanisms.

20 Claims, 14 Drawing Figures

INSERT FOR LAMINATED DOORS

BACKGROUND OF THE INVENTION

1. Field of the Invention

The present invention relates to the manufacture of laminated doors and, more particularly, to a lock mounting insert for positioning between spaced facing sheets of a door assembly during early phases of the manufacture of a laminated door. The insert is designed so that it can accommodate door lock mechanisms of a variety of sizes and configurations.

2. Prior Art

In the manufacture of laminated doors, facing sheets formed from a variety of materials such as steel, wood, or plastics are held in closely spaced relationship. The facing sheets are often referred to as "skins." Where metal skins are used, each skin is usually provided with one or more edge flange formations extending at right angles relative to the main face of the skin. When skins of this type are assembled, the edge flange formations define opposed edges of the door. Where skins other than metal are used, rails or strips of material made from wood or plastics material are positioned about the periphery of the door to provide edge structures for the completed door.

Regardless of the material from which the skins are formed, it is desirable to fill the cavity between the spaced skins with a suitable filler material such as expanded polystyrene or polyurethane foam. The injection of this filler material into the cavity between the skins is referred to as "foaming." Once the foam solidifies or "sets," it serves to bond the skins to form a sturdy, solid, dimensionally stable door. Foam-filled doors are also desirable from the point of view of providing acoustical and thermal insulation.

In the foaming of doors, it is necessary to apply pressure to the exterior faces of the skins so that the skins will not deflect outwardly under the influence of internal pressure generated by the foam as it expands within the door cavity. If inadequate support is provided, the skins can be caused to deform and/or separate to the extent that foam is permitted to escape. If the foaming operation is carried out properly, the entire volume of the door cavity will be filled and the desired dimensional tolerances of the door will be maintained.

A problem encountered in the fabrication of foam-laminated doors is that certain areas between the skins should be left open for the eventual installation of a lock mechanism which has portions that are desirably positioned between the spaced skins. In order to facilitate the installation of locks on foamed doors, it is advantageous to form lock-receiving openings in the doors during their manufacture. Unfortunately, if openings are provided through the skins and through the door edge portions of foamed in situ door constructions, foam may escape through and/or occupy these openings during the foaming operation. This is not acceptable and the openings must be obturated in some way during foaming.

One proposal for addressing this problem has been to place an insert between the skins adjacent the preformed openings so that, during foaming, the entire volume of the door cavity except for the region of the insert is filled by the expanding foam. Where the insert performs properly, it eliminates the need for subsequent drilling, cutting and other types of foam-removal operations.

A problem with prior inserts, however, relates to their method of manufacture and their inability (1) to adapt to different door constructions, (2) to accommodate locks of different sizes and shapes, and (3) to accommodate locks having one of a selected number of a desired "set back" dimensions. Prior inserts have been made by hand from wood in a variety of configurations. These inserts have had separate components which are usually stapled together by hand. The construction of these inserts is time consuming and expensive. In fact, the speed with which these inserts can be formed often is the single most significant factor in determining the rate at which doors can be constructed. Moreover, inserts made of wood often fail to perform satisfactorily because they often are not strong enough to resist distortion under the high pressures experienced during the foaming operation. Desirably, such inserts should also provide good points of attachment for certain door lock elements; however, inserts made of wood do not adequately serve this purpose.

SUMMARY OF THE INVENTION

The present invention overcomes the foregoing and other drawbacks of prior laminated door construction techniques, by providing a highly versatile, yet inexpensive insert formed from molded plastics material which may be adapted for use with a wide variety of door configurations and various standard-sized lock components.

The insert can be manufactured easily and inexpensively utilizing injection molding techniques. The inset is designed such that its manufactured configuration can be changed easily to accommodate various types of door structures and to accomodate various lock "set back" dimensions. With the practice of the present invention, manufacture of the insert itself no longer constitutes a limiting factor in determining the speed with which foamed laminated doors may be fabricated.

In one embodiment of the invention, the insert includes a door edge plate for covering an opening in the edge of a door assembly which is to be foamed. The door edge plate is an elongate structure lying in a first plane paralleling one edge of the door. The edge plate includes a plurality of openings that are aligned along a major axis of the plate. These aligned openings are covered by relatively thin membranes, one or more of which may be removed as necessary to accommodate different lock locations. The edge plate also includes small openings for the secure connection thereto of a door edge cover.

The insert also includes a receptacle which is engageable with the door edge plate adjacent a selected one of the aligned openings. The receptacle is configured to be positioned between the spaced skins of a door to surround preformed lock-receiving openings formed through the door skins. In one embodiment of the invention, the connection between the receptacle and the door edge plate is made by a pair of outwardly extending tabs which are engageable with opposed side portions of a selected one of the aligned openings formed in the door edge plate. The tabs may be resiliently flexed toward each other to pass through the opening, whereafter the tabs return to their normal spaced-apart position wherein they engage spaced side portions of the door edge plate to retain the receptacle in place with respect to the door edge plate. The tabs are retained in place in the opening by teeth which project outwardly from the tabs.

The receptacle includes end surfaces defining second and third planes which extend parallel with each other and normal to the edge of the door. These end surfaces are engageable with the lamination which forms the faces of the door. The receptacle assists in controlling the spacing between laminations, and it also prevents foam from being discharged from the interior of the door into the region of the preformed lock-receiving openings. The receptacle includes a laterally directed opening aligned with the openings in the door edge plates. The size and shape of the laterally directed opening is such as to accommodate standard sized lock bolt assemblies. The receptacle also includes a lock mechanism insertion opening whose axis is directed at right angles to the laterally directed opening, and whose size is such as to receive lock mechanisms of one standard dimension.

In addition to the foregoing construction, the receptacle includes an outwardly deployed rib lying in a plane generally parallel with the second and third planes and positioned midway between the end surfaces. The rib is integral with the receptacle and preferably has openings for foam material to pass therethrough. Upon setting, the foam will interact with the rib and the openings therein to enhance the stable positioning of the insert within the door. The rib also provides a stiffening function to prevent undesired distortion of the receptacle during the foaming operation.

The invention also includes an adapter receptacle which may be disposed within the primary receptacle. The adapter has an opening smaller in diameter than the lock mechanism insertion opening of the primary receptacle. By this technique, openings can be made available for the reception of lock mechanisms of alternate sizes.

Although the foregoing construction is preferred, the invention also includes certain alternative embodiments relating to the connection between the door edge plate and the receptacle. The alternative embodiments include a bayonet-type interconnection between the edge plate and the receptacle, and various edge plate/receptacle connections which will permit the spacing between the center line of the receptacle and the edge plate to be adjusted as desired.

There are important advantages which flow from the molding of the insert of plastic in that it can be dimensionally very stable and very precise so that proper sealing contact with the door laminations is possible and chances for leakage of the foam is greatly reduced. A problem exists, however, in that the configuration of these inserts is necessarily complex, and a mold for producing them in one-piece would require moving parts and a capital cost that would be prohibitive. However, in accordance with a further feature of the present invention, it is possible to make the insert in separate pieces, each of which can be produced in a relatively simple mold, but each part being so configured that it is directly and easily assemblable by hand with the other part or parts without the use of tools or independent fasteners to produce a complete insert of the desired overall configuration. The resulting insert assembly can be handled as a unit in effecting door assembly. As a result, the capital cost of the tools for producing the insert are brought into proper perspective, while the overall labor requirements in connection with the manufacture and use of the insert are likewise significantly reduced.

BRIEF DESCRIPTION OF THE DRAWINGS

The foregoing and other features and advantages, and a fuller understanding of the invention, may be had by referring to the following description and claims, taken in conjunction with the accompanying drawings, wherein:

DESCRIPTION OF THE PREFERRED EMBODIMENT

Figure 1:
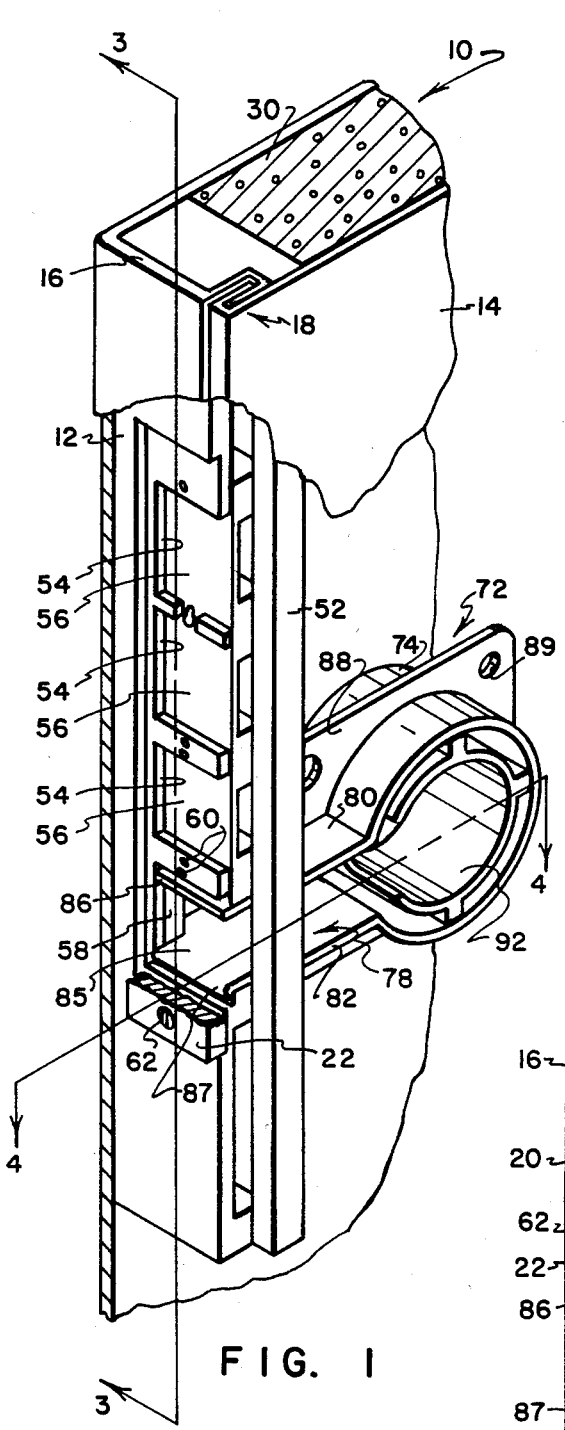
FIG. 1 is a perspective view of an insert according to the invention installed in place within a laminated door, with portions of the door being broken away and removed for clarity of illustration.
Figure 2:
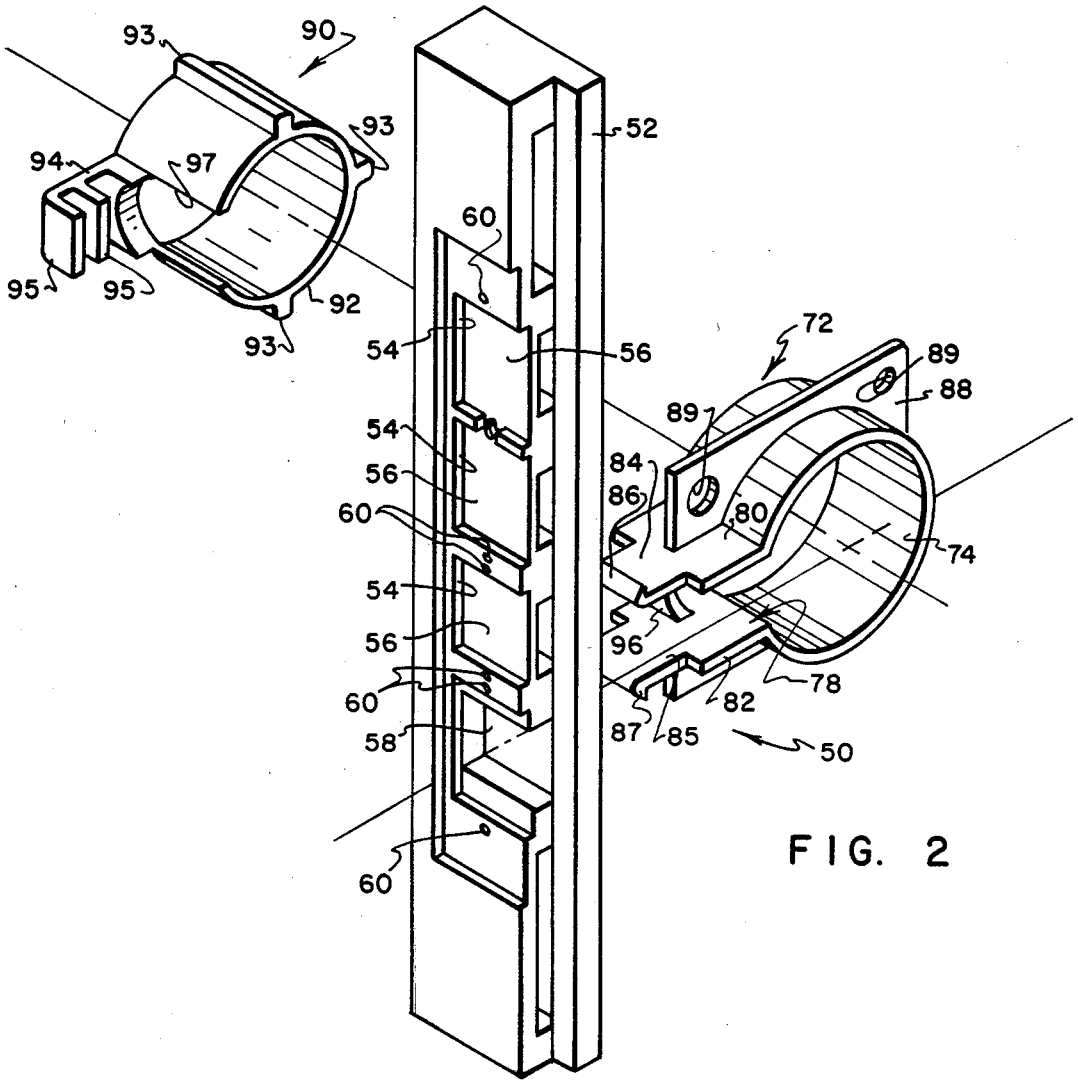
FIG. 2 is an exploded perspective view of an insert according to the invention prior to its installation in a door.
Figure 4:
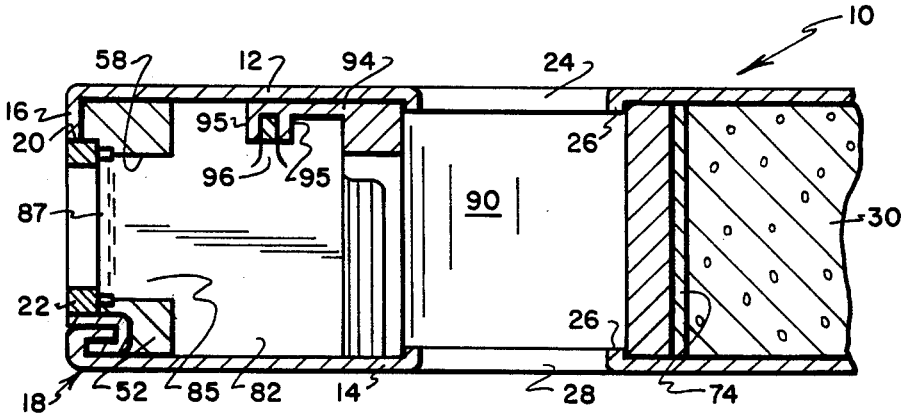
FIG. 4 is an enlarged section of the construction shown in FIG. 1, as viewed substantially from a plane indicated by a line 4—4 in FIG. 1, but also showing the door filling material in place.

Referring to FIGS. 1, 2 and 4, an inexpensive molded insert is shown in connection with a laminated door indicated generally by the numeral 10. The door 10 includes a pair of skin members 12, 14. The skin member 12 has formed therein a flange 16 which forms one edge of the completed door. Both the flange 16 and the skin member 14 are marginally crimped to form a joint 18 (FIGS. 1 and 4) which provides for their connection to make a unitary door.

Figure 3:
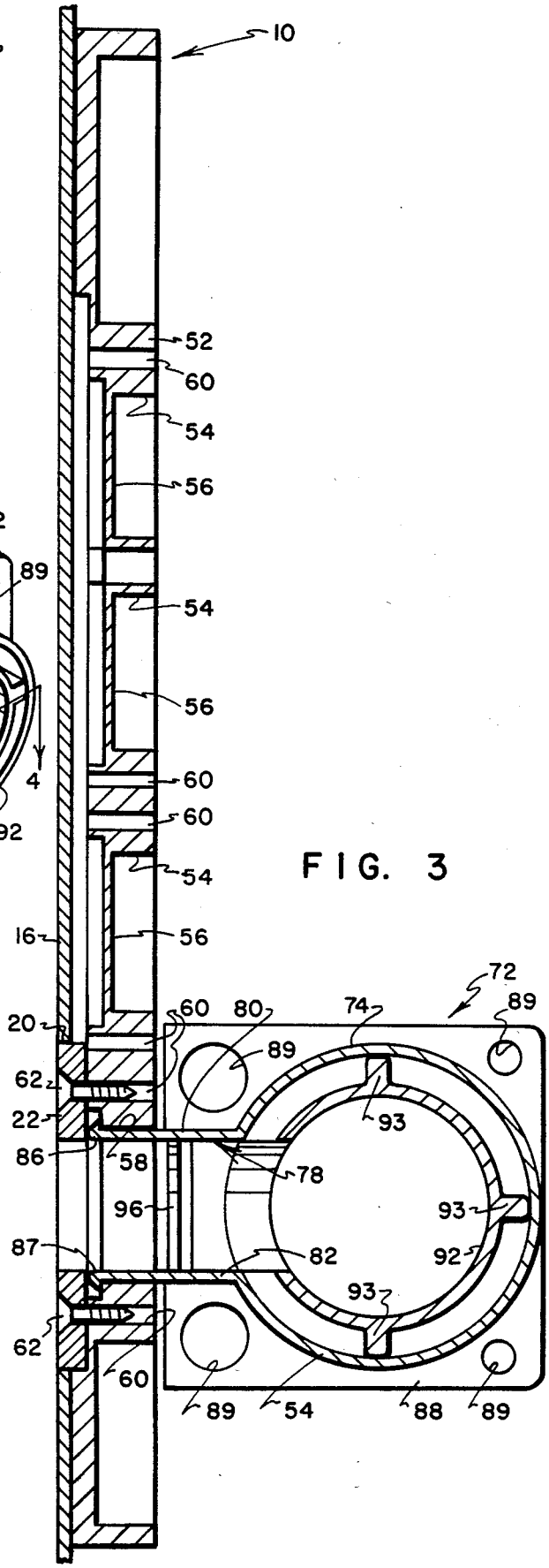
FIG. 3 is an enlarged section of the construction shown in FIG. 1, as viewed substantially from a plane indicated by a line 3—3 in FIG. 1.

During the preparation of the skin members such as 12 and 14, it is customary to punch openings at the locations where they will ultimately be required for cooperation with door hardware such as locks and hinges. One such opening is shown in the edge flange at 20 (FIGS. 3 and 4). This opening is designed to receive a conventional cover plate 22.

As is best seen in FIG. 4 openings 24 and 28 are also customarily prepunched in the skin members 12 and 14 respectively to provide access for a conventional lock mechanism (not shown). These latter two openings frequently form slight inwardly directed flanges or lips 26, whose purpose will presently appear.

When the door 10 is being completed, one of the last steps involves filling the hollow interior or cavity of the door with material which will expand and fill the door, adhering to the skin members and strengthening the door as well as rendering it heat and sound insulating. This material is usually plastic foam and is indicated at 30 in FIGS. 1 and 4, but is omitted from most portions of the views to avoid obscuring important features of the insert.

The function of the present invention is to provide a highly adaptable and cost saving insert which will reserve space within the door for the lock mechanisms to be later installed and which will at the same time seal such openings as the openings 20, 24, and 28 against leakage of the foam material either into the reserved space or to the door exterior.

The basic insert itself is perhaps best seen in the exploded view, FIG. 2, and is designated generally by the reference character 50. It consists basically of two parts, a door edge plate 52 and a lock receiving attachment 72. These pieces are molded of plastic material so as to fit accurately and tightly against those door parts with which they are designed to cooperate, and to provide an efficient seal at such points of contact. The door edge plate 52 is molded in a single piece whose width matches the inside dimension of the door between the skins 24, 28, and, as molded, is provided with no actual openings. It does, however, have a plurality of inchoate openings 54 closed by plastic membranes 56. The membranes 56 are strong enough to withstand the pressure of the injected material during foaming of the door, but are also thin enough to be readily cut out at any selected location to provide an opening through which a lock bolt will subsequently pass.

The inchoate openings 54 are intended for selective use, and may be designed individually for lock bolts of different types, or may be similarly shaped for use with plural locks where required. In the particular form shown in the drawings, a door requiring a single lock is being illustrated, and the lowermost inchoate opening has had its membrane removed to create an opening 58 which will provide for passage of a lock bolt.

The door edge plate 52 is also molded with small openings 60 designed to receive fasteners such as screws 62 which are used for attaching the exterior hardware, e.g. the edge cover plate 22, best seen in FIG. 3.

To complete the basic insert 50, there is provided a lock receiving attachment 72 which, in this case, comprises a receptacle 74, open at both ends and having end surfaces whose spacing matches the inside dimension of the door between the skins 24, 28. The receptacle 74 also has a lateral opening 78 and a pair of laterally extending housing plates 80 and 82 which embrace the opening 78 and are designed to eventually receive between them the bolt of a lock mechanism. The housing plates terminate respectively in tabs 84, 85. The extremities of the tabs 84, 85 are provided respectively with teeth 86, 87 which will snap over the edges of the opening 58 when the lock receiving attachment 72 is placed in engagement with periphery of the opening 58, and the shoulders at the base of the tabs are forced into contact with the inner face of the door edge plate 52.

The lock receiving attachment 72 also includes an integral fin 88 surrounding the receptacle and lying in a plane generally parallel to the end surfaces of the receptacle. In the preferred form the fin 88 includes openings 89 which will help to interlock the fin with the subsequently introduced foam 30. The fin 88, in cooperation with the foam 30, will provide a firm, mechanically integrated structure when the foam has set. The fin also serves to strengthen the receptacle against collapse under the pressure applied to it during the foaming operation.

FIGS. 1 to 4 also illustrate another feature of the invention, namely the possibility for flexibility in adapting a given insert 10 to lock mechanisms of different sizes, inasmuch as the practical art embraces several sizes as being standard.

For example, if the lock receiving attachment 72 is designed to accept locks of the larger of two sizes, it is possible to make it convertible to accept the other size by using a receptacle adapter 90 which is best seen in FIG. 2.

The receptacle adapter 90 includes a receptacle 92 of reduced size which is the same length as the primary receptacle 74 but of smaller perimeter and is made to fit within the receptacle 74. If the sizes are sufficiently different, integral ribs 93 are used on the exterior of the receptacle adapter to properly position the adapter within the primary receptacle without requiring excessive material. In the case of a cylindrical receptacle, which is the commonly employed configuration, the adapter 90 includes an arm 94 which includes positioning fingers 95, 95 so located as to embrace a web 96 provided on the lock receiving attachment 72. The meshing of the fingers 95, 95 with the web 96 keeps the receptacle adapter properly oriented so that its lateral opening 97 remains aligned with the lateral opening 78 of the primary receptacle.

In use, the appropriate insert elements are selected, such as the door edge plate and the appropriate lock receiving attachment 72. The lock receiving attachment may be equipped with a receptacle adapter 90 if the smaller size standard lock is to be used. One of the membranes 56 in a selected inchoate opening 54 is cut out to provide an opening 58. The tabs 84, 85 are sprung towards each other slightly and inserted into the opening 58. When the teeth 86, 87 clear the other side of the opening 58 they will move to locked position as seen in FIGS. 1 and 3 and the shoulders at the base of the tabs 84, 85 will be seated tightly against the inner face of the door edge plate 52.

The completed insert 50 is then handleable as a unit and can be easily located between the skin members 12 and 14 of the door with the door edge plate 52 against the inner face of the door edge flange 16 and with the receptacle opening lined up with the openings 24 and 28 in the skin members 12 and 14. As the skin members 12 and 14 are closed upon the insert 50, the lips 26 at the peripheries of the openings 24 and 28 will enter the end openings of the receptacle adapter 90 (if used) or of the receptacle 74 if the adapter is not required. The interengagement of the lips 26 with the end opening of the receptacle as seen in FIG. 4 will accurately locate and retain all parts of the insert 50 in proper position. The closing of the skin members 12 and 14 against the opposite faces of the insert 50 will effectively seal all of the vacuities within the receptacle 74 and between the housing plates 80, 82 against entrance of foam material while the balance of the door interior is being foamed. The skin members 12, 14 are customarily held firmly against the insert 50 by external pressure, and the accurately molded surfaces of the plastic parts of the insert 50 insure uniform sealing contact at all points.

When the foaming of the door is complete the exterior can be finished by, for example, applying door hardware such as the edge cover plate 22 and fastening the same in place by means of screws 62 engaging in the appropriate preformed openings 60 provided in the door edge plate portion 52 of the insert 50.

FIGS. 5 through 14 illustrate, in simplified fashion, the principles of various alternate structures for carrying out the fundamental ends of the present invention.

Figure 5:
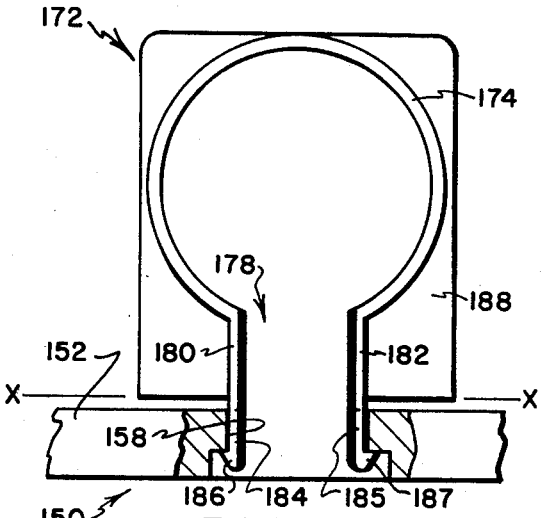
FIG. 5 is a side elevational view with parts broken away, illustrating in simplified form the principle of construction involved in the insert shown in FIGS. 1–4.

FIG. 5 is a simplified showing of the principle of constructing the device of FIGS. 1 to 4 and shows an insert 150 comprising a door edge plate 152 having an opening 158 cooperating with a lock receiving attachment 172 consisting of a receptacle 174 having a lateral opening 178, housing plates 180, 182, tabs 184 and 185, teeth 186 and 187 and a fin 188. The manner of assembly and use are identical with the form shown in FIGS. 1 to 4 and will be fully understood from the previous description in relation to the detailed illustration.

Figure 6:
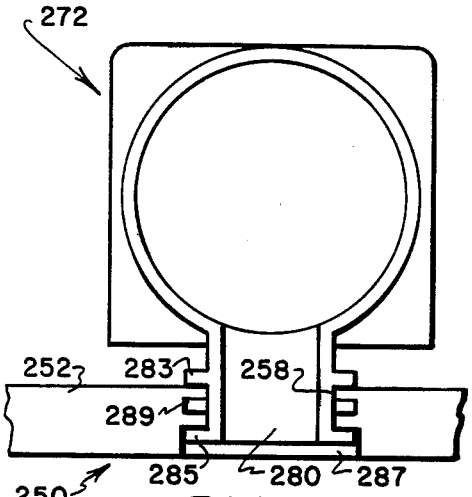
FIG. 6 is a side elevational view of an alternative embodiment of the invention, in which a lock bolt housing member is provided between an edge plate and a receptacle, the arrangement being such as to permit the spacing between the receptacle and the edge plate to be adjusted.
Figure 7:
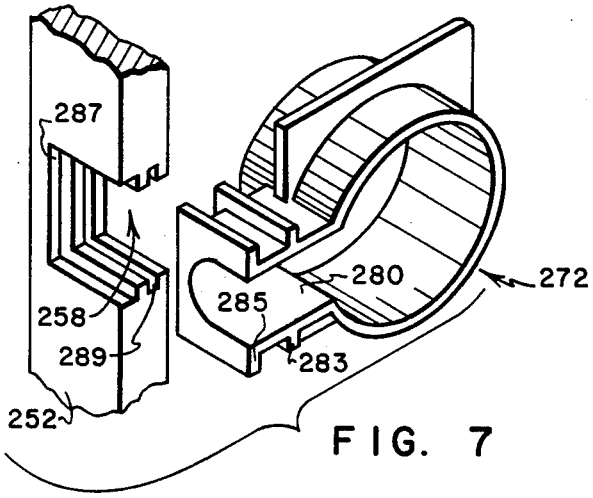
FIG. 7 is an exploded perspective view of the device shown in FIG. 6.

FIGS. 6 and 7 show an alternate form of the invention in which an insert 250 comprises a door edge plate 252 which cooperates with a lock receiving attachment 272. In this case the lock receiving attachment is an essentially rigid molded piece which includes an integral laterally extending housing element 280. The housing element 280 is characterized by exterior ribs 283 and 285 on its three sides. The door edge plate 252 has a recess 258 molded therein as seen in detail in FIG. 7. This recess extends part of the way across the door edge plate 252 and is open to one of the edges of the door edge plate as well as both faces thereof. At one face of the plate 252, the recess 258 is characterized by an enlarged cavity 287, and between this cavity and the opposite face in a rib receiving groove 289 extending around the three walls of the recess 258. The cavity 287, groove 289 and the ribs 283 and 285 are positioned for cooperation in such a manner that the parts 252 and 272 can be assembled by sliding the housing element 280 into the recess 258 from the open side thereof in two distinct relationships. The first of these is shown in FIG. 6 wherein the rib 285 rests in the enlarged cavity 287 and against the inner wall thereof. In this position the rib 283 is in engagement with the opposite face of the plate 252 and thereby positions the lock receiving attachment against being forced outwardly during foaming of the door. This first position represents a configuration applicable for hardware requiring a short spacing between the lock cylinder and the door edge. When a greater spacing is needed, the parts would be assembled with the rib 285 entered into the groove 289. It will be understood that a variation of this construction could be availed of by providing a thicker plate 252 and allowing the rib 283 to be entered into the groove 289 to provide still another alternative spacing between the lock cylinder and the door edge.

Figure 8:
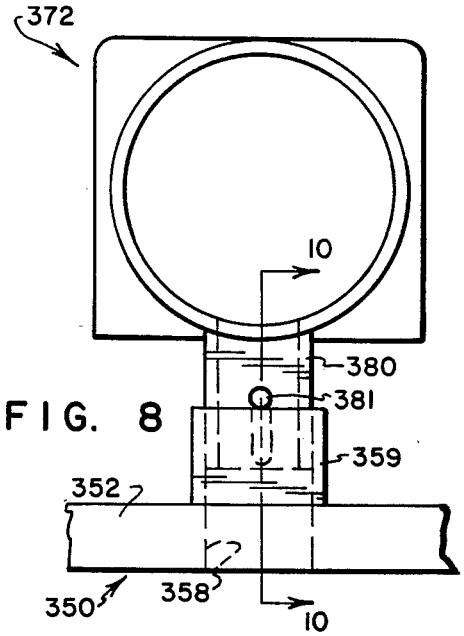
FIGS. 8, 9, and 10 are, respectively, a front elevational view, a rear elevational view, and a sectional view as seen from a plane indicated by a line 10—10 in FIG. 8, illustrating an alternative lock bolt housing for providing a connection between a door edge plate and a receptacle, which connection will permit the spacing between the receptacle and door edge plate to be adjusted.
Figure 9:
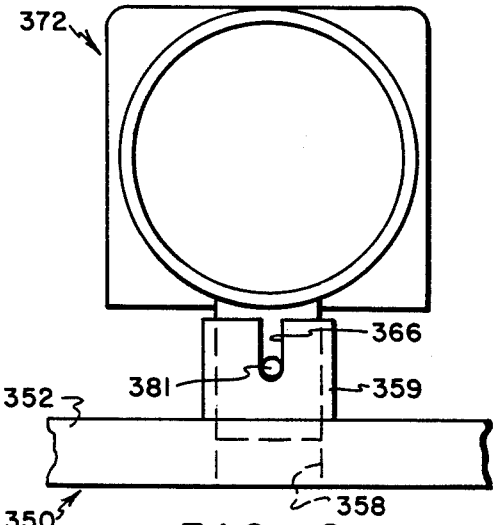
Figure 10:
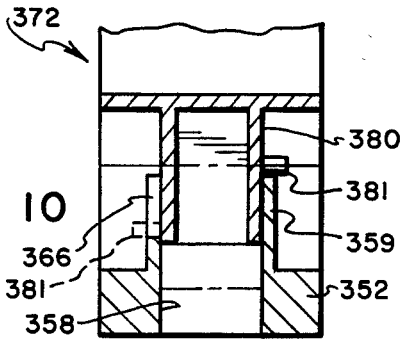

FIGS. 8, 9 and 10, illustrate another construction for providing for alternate spacing between the lock cylinder and the door edge. In this embodiment the insert is designated 350 and comprises a door edge plate 352 cooperating with a lock receiving attachment 372. In this embodiment, the parts are also essentially rigid molded pieces. The door edge plate 352 includes an opening 358 and an internal socket 359 which forms an extension of the opening 358. The lock receiving attachment 372 includes an integral laterally extending housing element 380 whose exterior matches the interior of the socket 359 and is a snug fit therein. On the exterior of the housing element 380 is an integral molded stop boss 381. The socket end at one point is relieved, as by a notch 366, in a manner to permit access of the boss 381 and allow the housing 380 to penetrate more deeply into the socket 359.

Using the insert 350 it is possible to accommodate hardware requiring one spacing between the lock cylinder and door edge by inserting the housing 380 into the socket 359 with the orientation shown in FIG. 8 and FIG. 10 (full line position) such that the boss 381 abuts the rim of the socket 359. When a shorter spacing distance is required by the hardware to be used, the lock receiving attachment can be positioned 180 degrees away from the first described position so that the boss 381 is in line with the relieved portion 366 of the socket rim, allowing the housing 380 to penetrate more deeply into the socket 359 as seen in FIG. 9 and in dotted lines in FIG. 10.

Figure 11:
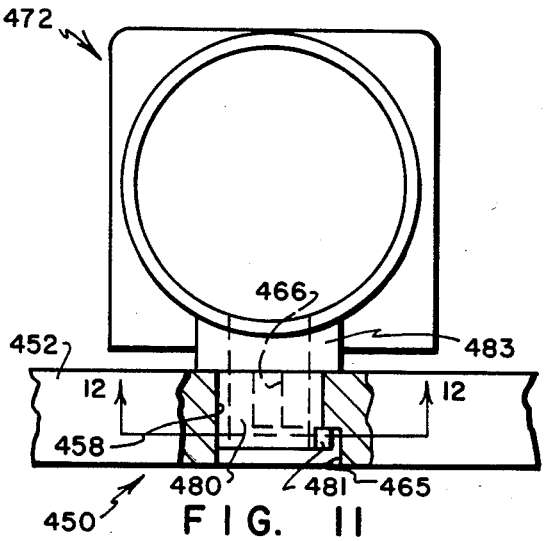
FIGS. 11 and 12 are, respectively, a side elevational view with parts broken away, and a sectional view as seen from a plane indicated by a line 12—12 in FIG. 11, illustrating another alternative technique for connecting a receptacle to an edge plate by means of a lock bolt housing; and, FIGS. 13 and 14 are, respectively, a side elevational view with parts broken away, and a sectional view as seen from a plane indicated by a line 14—14 in FIG. 13, illustrating yet another technique for connecting a receptacle and a door edge plate by means of a lock bolt housing.
Figure 12:
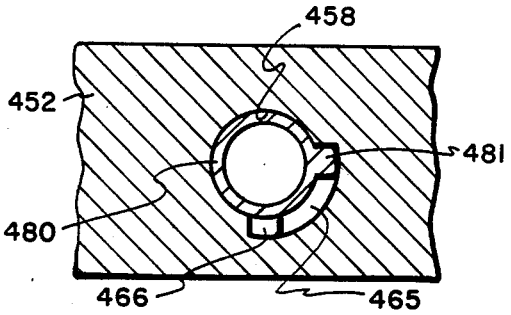

Turning now to the embodiment illustrated in FIGS. 11 and 12, means is shown for permitting a bayonet type connection between the door edge plate and the lock receiving attachment. In this case the insert generally is designated by the reference character 450 and includes a door edge plate 452 cooperating with a lock receiving attachment 472. The plate 452 is molded with an opening 458, in this case generally cylindrical in configuration. The opening 458 is characterized by an arcuate recess 465 adjacent the outer face of the plate 452, and a slot 466 extending from face to face of the plate 452 and opening into the arcuate enlargement 465 at one of its ends. The lock receiving attachment 472 includes an integrally molded laterally extending housing element 480 which is generally cylindrical in configuration and has a diameter which fits the opening 458. At its extremity the housing element 480 has an integral exterior lug 481 designed to be received in the slot 466. At its inner end the housing element 480 is characterized by a cylindrical enlargement 483.

To assemble the parts of the insert, the lug 481 of the housing 480 is aligned with the slot 466 of the opening 458, and the housing 480 is inserted into the opening 458 until the enlargement 483 seats against the inner surface of the plate 452. The lock receiving attachment 472 is then rotated until the lug 481 encounters the other end of the arcuate recess 465 as seen in FIG. 12, at which time the assembly is complete. It will be noted that the enlargement 483 serves to provide a stop to properly locate the lock receiving attachment 472 with respect to the outer face of the plate 452, and also has a diameter sufficient to overlie the end of the slot 466 and seal it against entry of the filling material while the door interior is being foamed.

Figure 14:
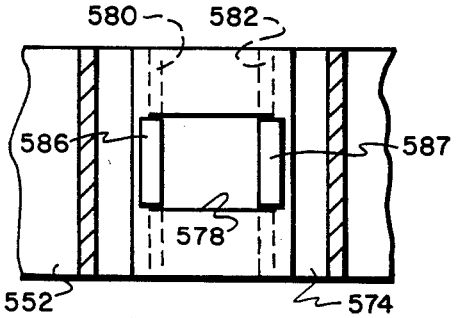
Figure 13:
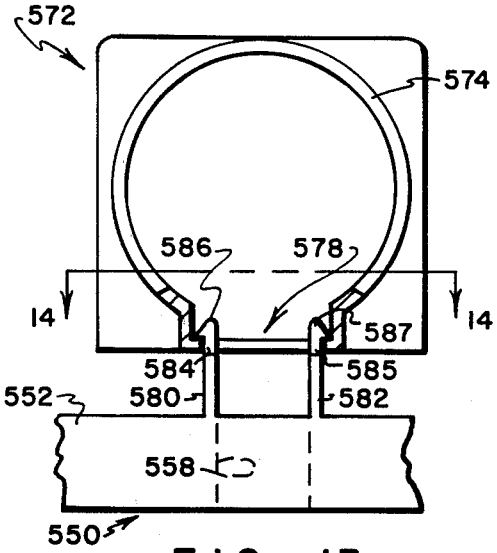

FIGS. 13 and 14 illustrate an embodiment which, in a sense, is the inverse of that shown in FIGS. 1 to 5. The insert generally is identified by the numerical 550 and includes a door edge 552 and a lock receiving attachment 572 which consists principally of the receptacle 574. The receptacle has a lateral opening 578 which is intended for alignment with an opening 558 molded into the door edge plate 552. In this case the laterally extending housing is formed by housing plates 580 and 582 molded integrally with the door edge plate 552. As can be seen in FIG. 14, these housing plates extend from end to end of the receptacle 574, i.e. the full width of the door edge plate 552. The housing plates 580 and 582 terminate respectively in short tabs 584 and 585 which enter the lateral opening 578 in the receptacle 574. At the tips of the tabs 584 and 585 are teeth 586 and 587. The plates 580 and 582 are somewhat resilient and allow the parts to be assembled by their deflection as the teeth pass through the opening 578. The relative position of the receptacle 574 and door edge plate 552 is then determined by the teeth 586 and 587 which engage the interior surface of the receptacle and the shoulders of the housing plates 580 and 582 where they meet the tabs 584 and 585, the shoulders abutting the receptacle exterior.

All of the devices herein described readily lend themselves to molding and may be constructed of various plastic materials. Materials which are substantially rigid but which still exhibit a slight capacity for compliance to promote good sealing contact are preferred. A representative material for this purpose is polypropylene.

While certain of the insert embodiments disclosed include the feature of adjustability in terms of selecting the spacing between the lock receiving receptacle and the door edge to suit differing hardware standards, it is also pointed out that even without such built-in adjustability, the teachings of this invention also afford an advantage in being able to produce a variety of inserts of any selected type but offering different spacings between the receptacle and the door edge in a relatively uncomplicated and economical manner.

Referring to FIG. 5 it can be seen that it is possible to mold the lock receiving attachment 172 by means of equipment which includes a mold insert. The primary cavity is designed to form the portion of the lock receiving attachment above the line X—X, and is built to cooperate with a mold insert whose cavity forms the portion of attachment 172 below the line X—X, in this case the tips of the housing plates 180, 182, the tabs 184, 185 and the teeth 186 and 187. By merely providing mold inserts whose cavities have different lengths for the tips of the housing plates 180, 182, the molded products obtained can be made to conform to a number of standard spacings. This type of procedure can also be applied to the other embodiments disclosed.

Although the invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention as hereinafter claimed. It is intended that the patent shall cover, by suitable expression in the appended claims, whatever features of the patentable novelty exist in the invention disclosed.

What is claimed is:

1. A plural part sealing insert assembly for use in the manufacture of laminated doors of the type that include a pair of spaced laminations that define opposed faces of the door and that define a space there between that is to be filled with a flowable filler material that hardens in situ, the sealing insert assembly serving to define lock-mounting openings and to prevent the filler from entering said openings during door manufacture, comprising:

(a) a door edge plate having a width equal to the spacing between the door laminations and having an opening means in the door edge plate for the passage of a lock bolt through the door edge;

(b) a receptacle for a lock cylinder, said receptacle having a length equal to the spacing between the door laminations and being open at each end for the reception of a lock cylinder, and the receptacle also having a lateral opening for access of the bolt lock mechanism;

(c) a lock bolt housing means providing an access connection between the lateral opening in the receptacle and the opening in the door edge plate;

(d) connection means integral with the parts of the insert assembly providing for direct manual connection of the parts of the insert assembly to form a complete insert assembly in the absence of independent fastening elements; and, (e) the insert assembly having formation means for engaging the door laminations to prevent entry into the opening means and the open ends of the receptacle of filler when a flowable filler is being delivered into the space between the door laminations to substantially fill said space.

2. The plural part sealing insert assembly of claim 1 wherein the parts of the assembly are each of molded plastic.

3. The plural part sealing insert assembly of claim 1 wherein the receptacle includes a surrounding fin formation which coacts with filler material of a laminated door to stabilize the insert assembly in a completed door and strengthen its integration with the completed door.

4. The plural part sealing insert assembly of claim 1 which further includes an adapter receptacle fitting within the lock cylinder receptacle and having a lateral opening alignable with the lateral opening of the lock cylinder receptacle for converting the insert assembly for use with a lock cylinder of smaller size.

5. The plural part sealing insert assembly of claim 1 wherein the door edge plate is elongate and in which the opening means in the door edge plate is a plurality of inchoate openings covered by integral readily removable membranes whereby selected inchoate openings may be activated for use by removing their membranes to allow use with selected lock mechanisms without allowing leakage of filler material through the non-selected inchoate openings.

6. The plural part sealing insert assembly of claim 1 wherein the lock bolt housing means comprises two deflectable housing plates formed integrally with the receptacle adjacent its lateral opening and whose widths are equal to the receptacle length for sealing engagement at their edges with the door laminations, and wherein the means providing for direct manual connection of the parts includes tabs at the extremities of the housing plates having teeth at their tips and engageable within the opening in the door edge plate.

7. A plural part sealing insert assembly for use in manufacturing laminated doors comprising:

(a) a door edge plate having a width equal to the spacing between the door laminations and having an opening means in the door edge plate for the passage of a lock bolt through the door edge;

(b) a receptacle for a lock cylinder, said receptacle having a length equal to the spacing between the door laminations and being open at each end for the reception of a lock cylinder, and the receptacle also having a lateral opening for access of the bolt lock mechanism;

(c) lock bolt housing means providing an access connection between the lateral opening in the receptacle and the opening in the door plate;

(d) means integral with the parts of the insert assembly providing for direct manual connection of the parts of insert assembly to form a complete insert assembly in the absence of independent fastening elements;

(e) the lock bolt housing means comprising two deflectable housing plates formed integrally with the door edge plate adjacent its opening and whose widths are equal to the receptacle length for sealing engagement at their edges with the door laminations; and, (f) the means providing for direct manual connection of the parts including tabs at the extremities of the housing plates and having teeth at their tips and being engageable within the lateral opening in the receptacle.

8. A plural part sealing insert assembly for use in manufacturing laminated doors comprising:

(a) a door edge plate having a width equal to the spacing between the door laminations and having an opening means in the door edge plate for the passage of a a lock bolt through the door edge;

(b) a receptacle for a lock cylinder, said receptacle having a length equal to the spacing between the door laminations and being open at each end for the reception of a lock cylinder, and the receptacle also having a lateral opening for access of the bolt lock mechanism;

(c) lock bolt housing means providing an access connection between the lateral opening in the receptacle and the opening in the door plate;

(d) means integral with the parts of the insert assembly providing for direct manual connection of the parts of insert assembly to form a complete insert assembly in the absence of independent fastening elements;

(e) the door edge plate opening being a recess opening through one side edge of the door plate;

(f) the recess surfaces being provided with groove means accessible from the edge opening into the recess; and, (g) the lock bolt housing means being integral with the receptacle and having on its exterior surface ribs matching the grooves in the recess, whereby the insert assembly parts can be connected by sliding the ribs on the lock bolt housing means laterally of the door edge plate into the groove means in the recess surfaces.

9. The plural part sealing insert assembly of claim 8 wherein the groove means and the ribs are so configured as to offer alternate meshing positions providing for the construction of sealing inserts with selective spacing between the receptacle and the edge of the door.

10. The plural part sealing insert of claim 1 wherein the lock bolt housing means comprises two nested tubular members, one integral with the door edge plate and one integral with the receptacle, and stop means on the extension of the internal tubular member for determining the degree of penetration of the internal tubular member into the external tubular member.

11. The plural part sealing insert of claim 10 wherein the external one of the nested tubular members has its end edge relieved by a notch which can be aligned with the stop in one orientation of the nested tubular members to provide for alternate spacings between the receptacle and the edge of the door.

12. A plural part sealing insert assembly for use in manufacturing laminated doors comprising:

(a) a door edge plate having a width equal to the spacing between the door laminations and having an opening means in the door edge plate for the passage of a lock bolt through the door edge;

(b) a receptacle for a lock cylinder, said receptacle having a length equal to the spacing between the door laminations and being open at each end for the reception of a lock cylinder, and the receptacle also having a lateral opening for access of the bolt lock mechanism;

(c) lock bolt housing means providing an access connection between the lateral opening in the receptacle and the opening in the door plate;

(d) means integral with the parts of the insert assembly providing for direct manual connection of the parts of insert assembly to form a complete insert assembly in the absence of independent fastening elements;

(e) the lock bolt housing means comprising a hollow, generally cylindrical member that is integral with the receptacle and has an exterior projection at one side thereof;

(f) the opening in the door edge plate being generally cylindrical, but including in its wall an axially extending groove of a size to receive the exterior projection on the cylindrical member, and including an arcuate vacuity in the face of the door edge plate intended for facing towards the door edge, whereby the parts can be connected by entering the cylindrical member into the door edge plate opening with the projection aligned with the groove and then rotating the projection into the arcuate vacuity when the cylindrical member is fully seated in the door edge plate opening; and (g) the lock bolt housing means including an enlarged portion on its exterior which seals off the groove against entry of the filling material when the door is being filled.

13. A sealing insert for use in manufacturing laminated doors of the type that include a pair of spaced, opposed laminations that define opposed faces of the door and that define a space there between that is to be filled with a flowable filler material that hardens in situ, the insert being fitted between the opposed laminations and being positioned along one edge of the door adjacent lock-receiving openings previously formed in the door, the sealing insert defining passages that interconnect selected ones of the lock-receiving openings and to prevent the filler from entering the lock-receiving openings and the passages, the insert comprising:

(a) a door edge plate lying in a first plane generally parallel with the edge of the door, the edge plate having a longer side defining a major axis, the edge plate having a plurality of opening means aligned along the major axis, the opening means being of a size and shape large enough to accommodate a standard-sized lock bolt;

(b) a receptacle connected to the edge plate, the receptacle having side edges lying in a second plane and a third plane generally perpendicular to the first plane, the side edges being in contact with the laminations forming the opposed faces of the door, the receptacle hving a first opening large enough to accept a standard-sized door lock mechanism, the opening having a center line oriented perpendicular to the second and third planes, the center line of the opening being spaced a predetermined distance from the door edge plate, and a second, lateral opening in the receptacle connecting the first opening and a selected one of the opening means in the door edge plate, the lateral opening being large enough to accommodate a standard-sized lock bolt; and, (c) the edge plate and the receptacle having formation means for cooperating with the opposed laminations to prevent entry into the lock-receiving openings and the passages of filler when a flowable filler is being delivered into the space between the laminations.

14. The insert of claim 13, wherein the receptacle further includes an upstanding rib lying in a plane generally parallel with the second and third planes and positioned approximately midway between the side edges, the rib including openings for the flowable filler material to pass through.

15. The insert of claim 1, wherein the receptacle cylinder plate is connected to the edge plate by means of outwardly extending tabs engageable with a selected opening in the edge plate, the tabs being integral with the remainder of the receptacle.

16. The insert of claim 15, wherein the tabs include teeth for engagement with the opening.

17. The insert of claim 13, further comprising adapter means engageable with the receptacle, the adapter means being insertable within the first opening of the receptacle and having an opening smaller in size than the first opening.

18. The insert of claim 13, wherein the opening means in the edge plate are in the form of inchoate openings covered by membranes, which membranes can be removed as desired for the connection of one or more receptacles.

19. The method of manufacturing laminated doors which comprises:

(a) individually molding parts of a plural part sealing insert assembly of plastic molding material said assembly comprising:

(i) a door edge plate having a width equal to the spacing between the door laminations and having an opening means in the door edge plate for the passage of a lock bolt through the door edge;

(ii) a receptacle for a lock cylinder, said receptacle having a length equal to the spacing between the door laminations and being open at each end for the reception of a lock cylinder; the receptacle also having a lateral opening for access of the bolt lock mechanism;

(iii) lock bolt housing means providing access connection between the lateral opening in the receptacle and the opening in the door edge plate; and (iv) means integral with the parts of the insert assembly providing for direct manual connection of the parts of the insert assembly to form a complete insert assembly in the absence of independent fastening elements;

(b) manually connecting said parts to form an integrated insert assembly;

(c) preparing laminations to make up the faces and edge of a door by punching hardware receiving openings therein;

(d) manually locating said integrated insert assembly between said laminations and in sealing relation to the hardware receiving openings therein;

(e) applying pressure to the outer faces of the laminations to bring about sealing contact between the inner faces of the laminations and the insert assembly; and (f) injecting filling material to fill the door cavity.

20. A laminated door comprising:

(a) an enclosure including a pair of spaced laminations which are devoid of openings except for hardware receiving openings formed therein;

(b) a plural part insert assembly of molded plastic material, said assembly including:

(i) a door edge plate having a width equal to the spacing between the door laminations and having an opening means in the door edge plate for the passage of a lock bolt through the door edge;

(ii) a receptacle for a lock cylinder, said receptacle having a length equal to the spacing between the door laminations and being open at each end for the reception of a lock cylinder; the receptacle also having a lateral opening for access of the bolt lock mechanism;

(iii) lock bolt housing means providing access connection between the lateral opening in the receptacle and the opening in the door edge plate; and (iv) connection means integral with the parts of the insert assembly providing for direct manual connection of the parts of the insert assembly to form a complete insert assembly in the absence of independent fastening elements, (c) said insert assembly being directly manually connected by said connection means to form an integrated insert assembly that is located and held between the laminations in sealing relation to the hardware receiving openings formed in the laminations and reserving space for the introduction of hardware; and, (d) filling material which has been injected into and fills such space as lies between the laminations other than that occupied by the insert assembly.

* * * * *